US005566475A

United States Patent [19]

Donnadieu

[11] Patent Number: 5,566,475

[45] Date of Patent: Oct. 22, 1996

[54] SPORTS BOOT HAVING AT LEAST A PARTIALLY ELASTIC LINING

[75] Inventor: Thierry Donnadieu, Poisy, France

[73] Assignee: Salomon S.A., Metz-Tessy, France

[21] Appl. No.: 336,644

[22] Filed: Nov. 4, 1994

[30] Foreign Application Priority Data

Nov. 4, 1993 [FR] France ..... 93 13299

[51] Int. Cl.[6] ..... A43B 23/07; A43B 11/00

[52] U.S. Cl. ..... 36/55; 36/51; 36/170

[58] Field of Search ..... 36/9 R, 117, 118, 36/119, 120, 121, 114, 169, 170, 51, 55, 45, 68, 69

[56] References Cited

U.S. PATENT DOCUMENTS

| | | | |
|---|---|---|---|
| 1,803,554 | 5/1931 | Knilans | 36/114 |
| 1,986,580 | 1/1935 | Johnson | 36/170 X |
| 2,147,197 | 2/1939 | Glidden | 36/45 X |
| 2,279,951 | 4/1942 | Morein | 36/170 |
| 2,539,761 | 1/1951 | Whitman | 36/170 X |
| 3,555,706 | 1/1971 | Edmonds | 36/114 |
| 4,534,123 | 8/1985 | Salomon et al. | 36/99 |
| 4,736,531 | 4/1988 | Richard | 36/114 |
| 5,319,869 | 6/1994 | McDonald et al. | 36/114 |
| 5,337,493 | 8/1994 | Hill | 36/55 X |
| 5,339,545 | 8/1994 | Paris | 36/55 X |
| 5,430,959 | 7/1995 | Mitsui | 36/114 X |

FOREIGN PATENT DOCUMENTS

| | | | |
|---|---|---|---|
| 2534459 | 4/1984 | France . | |
| 2690050 | 10/1993 | France . | |
| 5076405 | 3/1993 | Japan | 36/55 |

*Primary Examiner*—B. Dayoan

*Attorney, Agent, or Firm*—Greenblum & Bernstein P.L.C.

[57] ABSTRACT

A boot that includes an outer sole, a stiffener surrounding the heel, a vamp, as well as a lining made of an elastic material extending over the top of the front-foot inside vamp, the vamp and the stiffener being assembled to the outer sole in a peripheral assembly zone of the sole. In accordance with the invention, the elastic lining does not have a base and is fixed by its lower peripheral edge to the outer sole, in the peripheral assembly zone of such sole, and lining is fixed at the rear, on each side of boot to the rear stiffener.

19 Claims, 3 Drawing Sheets

SPORTS BOOT HAVING AT LEAST A PARTIALLY ELASTIC LINING

FIELD OF THE INVENTION

The present invention is related to a sports boot, more specifically intended for gliding sports such as cross-country skiing, ice or roller (aligned roller blades) skating, such boot being of the type including an outer sole, a stiffener surrounding the heel, an outer vamp having an opening at the front for the passage of the foot as well as a lining made of an elastic material extending over the top from the front foot inside the upper.

DESCRIPTION OF BACKGROUND AND OTHER INFORMATION

Sports boots with elastic linings are known in the art.

For example, U.S. Pat. No. 2,147,197 discloses a sports boot constituted by an inner elastic sock anchored by its base on the sole and by a partial external upper provided with tightening means for the foot and fixed onto the sole completely independently of the sock.

Similarly, U.S. Pat. No. 4,736,531 discloses a similar boot, adapted more specifically for aerobics, that includes a sort of inner half-sock completely surrounding the front foot and whose base is anchored on the outer sole, the sock being free to "grip" the foot independently of the outer upper.

The aim of such boots is to be more comfortable and "stretchable" with respect to ordinary boots.

Furthermore, the special elastic half-sock structure of U.S. Pat. No. 4,736,531 is meant to enable the boot to fully adapt itself to the foot, i.e., to follow the latter during the quick movements that are undertaken in such a discipline.

In a boot more specifically adapted to gliding sports, the problems encountered are totally different and consequently, are not resolved by the boots described in the above-cited patents. Indeed, in gliding sports, one of the most important issues that needs solving is the balance problem, due to the fact that the sport is practiced on a "gliding" element that is thus mobile with respect to the ground. It therefore becomes necessary for the sportsman to perceive positive spatial sensations, both from his or her limbs as well as from the sliding member.

Thus, the critical factor is the transmission of information coming from the sliding member towards the foot and the leg.

A problem of this type has already been addressed in the field of cross-country skiing by the Applicant in its French patent publication No. 2,690,050, published on Oct. 22, 1993, as regards researching the transmission of information originating from the ski towards the ankle, when no mechanical connection exists between the upper and the ankle, or in a case wherein such linkage is obtained by a rigid collar extending an upper portion of said upper.

It has been suggested that this problem can be solved by arranging a collar extending from the top of the upper towards the ankle, such collar being made of a stretchable material so as to ensure an exact fit thereof to the contours of the ankle and to thus provide a sensor effect in connection with the foot-sensor constituted by the tightening of the instep of the upper of the boot, the tightening ensuring retention of the foot.

Although this solution has substantially improved the manner in which information is transmitted, it is nonetheless incomplete, because the chain of transmission is interrupted in the area of the foot, or at least disturbed, by the presence of the rigid portions constituting the upper.

SUMMARY OF THE INVENTION

An object of the present invention is therefore to overcome the aforementioned disadvantages and to disclose a sports boot that enables the foot, and where relevant, the glide member with respect to the ankle, to obtain positive sensations, and thus to provide accurate information regarding their respective spatial positions that are indispensable to a good accuracy of motion, taking support, and where necessary, guidance of the glide member.

This object is achieved in the boot according to the invention, which is of the type having an outer sole, a stiffener surrounding the heel, a vamp, as well as a lining made of an elastic material extending over the top of the front-foot portion inside the vamp, the vamp and the rear stiffener being assembled to the external sole in a peripheral assembly zone of the sole, due to the fact that the elastic lining does not have a base and is fixed by its lower peripheral edge to the outer sole, in the peripheral assembly zone of such sole, and due to the fact that the lining is fixed at the rear, on each side of the boot, to the rear stiffener.

The fact that the elastic lining does not have a base and is fixed, on the one hand, by its peripheral edge to the outer sole, and on the other hand, to the rear stiffener, enables one to sense the position of such elastic lining, and forces acting thereon, i.e., "reinforcing" of the elastic lining with respect to the rigid portions in contact with the lower surface of the foot and the rear portion thereof and therefore enables an optimum referencing of the entire foot and ankle with respect to the glide member.

This results in vastly improved foot positioning and guidance precision sensations, enabling significant differences to be achieved as regards balance, stability and taking support, during the practice of gliding sports, and especially cross-country skiing.

According to an advantageous embodiment, the lining is constituted, at least in the portion covering the front-foot, of two layers of elastic fabric connected together by a peripheral stitching, before assembly on the boot, and only the outer fabric layer is connected to the stiffener. In this way, optimum foot comfort is guaranteed due to the elimination of the connecting stitching between the lining and the stiffener within the boot, especially in the particularly sensitive instep zone.

In this case, it is also advantageous to ensure that the assembly to the sole is obtained by means of an inner elastic fabric layer.

As such, one obtains a continuity of the lining in contact with the foot and therefore a heightened comfort level, whilst avoiding all over-thicknesses in the fabric at the level of the assembly zone that would be detrimental to good assembly.

In accordance with another interesting embodiment, the elastic lining substantially has the shape of a sock without a base covering the entire foot and the ankle. Such a construction is especially adapted to the practice of a sport requiring smooth/free/rhythmic foot motions such as classic cross-country skiing, as it enables an optimum sensation and referencing of the foot/ankle assembly.

BRIEF DESCRIPTION OF THE DRAWINGS

The invention will be better understood and other characteristics thereof will become apparent from the description that follows, with reference to the annexed schematic drawing, representing non-limiting examples of several preferred embodiments of the invention and wherein.

DETAILED DESCRIPTION OF PREFERRED EMBODIMENTS

Figure 1:
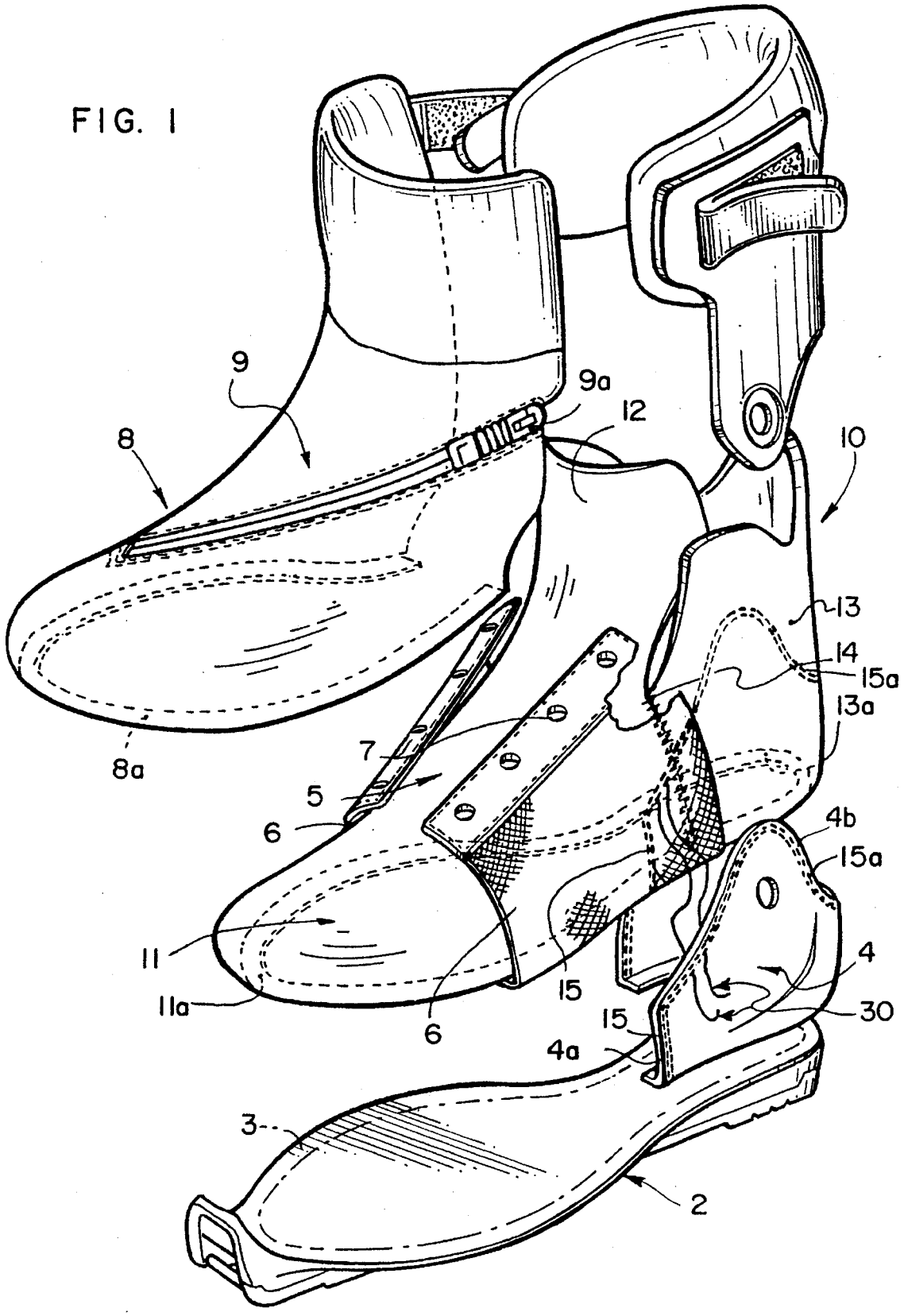
FIG. 1 is an exploded perspective view of a sports boot according to the invention, especially adapted to the cross-country skiing skating technique.

The sports boot shown in FIG. 1 in an exploded perspective view is a cross-country ski boot, more specifically adapted to the practice of the so-called skate step or skating, such a technique also being related to ice skating, roller skating or aligned roller skating techniques.

This boot includes:

an outer sole 2 having a peripheral assembly zone 3, a stiffener 4 surrounding and reinforcing the outer zone of the heel of the boot, an inner tightening system 5, constituted of two tightening quarters 6 adapted to tighten the foot of the wearer in the area of the instep, each of such quarters 6 being constituted by a strip of flexible fabric having a substantially rectangular shape that is anchored at one end **6*a* on outer sole 2 in the area of its assembly zone 3 and whose other free end bears the tightening means 7, that incidentally are eyelets for the passage of a lace, a vamp 8, constituting along with stiffener 4, the main upper portion of the boot and covering the inner tightening system 5, such vamp being fixed by its peripheral edge 8*a* to the outer sole and to the front edge 4*a* of the stiffener, and a lining 10** covering the entire inner portion of the boot.

Such a boot also includes, in a known manner, an assembly insole and an inner sole, such elements not being represented in FIG. 1 for reasons of clarity.

Also in a known manner, vamp 8 includes an opening 9, closed incidentally by a slide closure **9*a***, intended to enable easy passage of the foot when the boot is put on. Such an opening can also be defined by a simple slit whose closure means would be constituted by a lacing system.

Lining 10 is, in the example of FIG. 1, constituted by two portions, in other words by a front portion 11 extending along the entire zone of the forepart of the foot, including the instep zone by forming a tongue 12, and a rear portion 13 intended to cover the entire heel portion of the boot.

The two lining portions 11, 13 are connected to one another in the area of the instep line of the boot by a substantially vertical stitching 14.

The front lining portion 11 has substantially the shape of a half-sock without base and is, therefore, fixed to outer sole 2 in the assembly zone 3 thereof, only by its lower peripheral edge **11*a*. Thus, the lower peripheral edge 11*a* defines an opening that is closed by the upper surface of the outer sole 2**.

Similarly, the rear lining portion 13 does not have a base and is fixed by its lower peripheral edge **13*a* to the outer sole 2. In addition, lining 10 is connected to front edge 4*a* of stiffener 4, in the area of the junction zone 14 of both its parts 11, 13 by a stitching 15. As can be seen in the drawing, this junction zone 14 is located substantially in the area of the flexion fold line of the boot. The thread 30 forming this stitching 15 is represented partially torn off on FIG. 1. In the case where one or both tightening quarters 6 are also fixed on front edge 4*a* of the stiffener, the same stitching 15 can be advantageously used for the simultaneous connection of the tightening quarter or quarters 6 and of lining 10 to such stiffener 4**.

Naturally, connection 15 of lining 10 to the stiffener is obtained on each of the sides of the boot.

The rear portion of lining 13 can also be completely stitched to the stiffener along the peripheral edge **4*b* thereof as represented in dotted and dashed lines 15*a***.

In the example represented, only the front portion 11 of the lining is made of an elastic material. This front portion 11 is, furthermore, designed so as to define, at rest, a volume that is slightly less than the volume of the foot which it intends to receive and, consequently, to exert a light pressure on the latter, without however, exerting an excessive tightening.

The front portion 11 thus adapts perfectly to the forepart of the foot and constitutes a sort of second skin for it.

With such a construction, a precise and comfortable enveloping of the front-foot is thus obtained, while enabling an optimum referencing with respect to the base of the foot (in contact with the sole) and to the heel (in contact with the stiffener).

This results in, especially due to the second skin effect, of vastly improved foot positioning and guidance precision sensations, as has been confirmed by tests, such sensations enabling significant differences to be perceived as regards balance, skiing aptitude and taking support.

Contrary to front portion 11, rear portion 13 of the lining is non-stretchable so as to ensure good heel retention.

Figure 2:
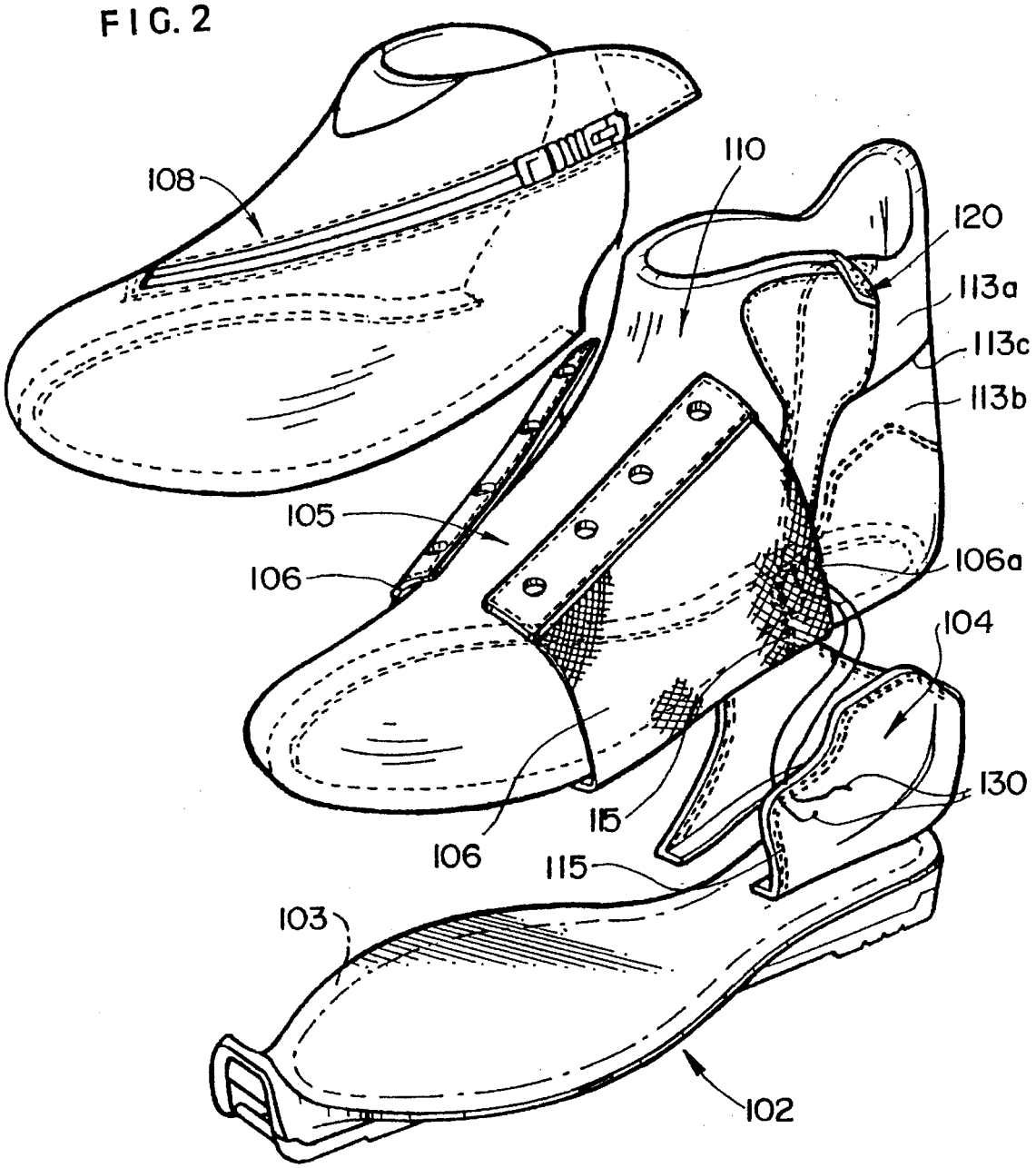
FIG. 2 is an exploded perspective view of a sports boot in accordance with the invention, more specifically adapted to the classic cross-country skiing technique.

FIG. 2 shows another embodiment of the invention, applied to a cross-country boot for practicing classic steps.

In this boot, having a basically similar construction, the same references increased by 100 will be used to designate similar or equivalent elements.

This boot is therefore also constituted by an outer sole 102, a stiffener 104, an inner tightening system 105, a vamp 108 and a lining 110, all of which are fixed onto the outer sole 102 at the level of its peripheral assembly zone 103.

The only difference between these two boots is to be found in the formation of lining 110, which here has the shape of an almost complete elastic liner, but still Without a base and intended consequently to cover the entire foot and ankle assembly.

In this case, rear portion 113 of the liner is elastic only in its upper half **113*a* whereas the lower portion 113*b* remains non-stretchable so as to guarantee good heel retention. The boundary 113*c*** between the upper and lower portions corresponds substantially to the upper limit of the zone of the malleoli.

In the same way as previously described, lining 110 is provided so as to exert a slight pressure on the foot, without compressing it and is stitched, in the area of the flexion fold line, both to the rear edge **106*a* of each of tightening quarters 106 and to the front edge of stiffener 104 by the same stitching 115 (represented by partially torn off threads 130), the rear portion 113*b* of the lining being stitched at 115*a* along stiffener 104. In the case of a boot of this type necessitating smooth/free/rhythmic foot motions, the connection of each of the tightening quarters 106** to the stiffener is especially important in order to obtain an optimum heel retention.

In addition, in order to facilitate the placement of the foot, lining 110 is provided, in the area of the heel, with a substantially vertical slit 120 extending from the free end of such lining up until its junction zone with the sole.

Such a construction of the elastic lining portion in a single piece enables excellent continuity to be obtained from the end of the foot up to the area of the ankle and, consequently, enables excellent transmission of information. Such a construction is adapted for the practice of a sport where the foot is freed completely as in the classic cross-country ski technique, or even for walking or foot races.

In both of the represented embodiments, the materials used to obtain such a boot are preferably chosen from among open cellular foams so as not to hinder perspiration transfer, such as PU foam, and/or complex fabrics associating such foams to elastic fibers, and especially to elastomer fibers.

Figure 3:
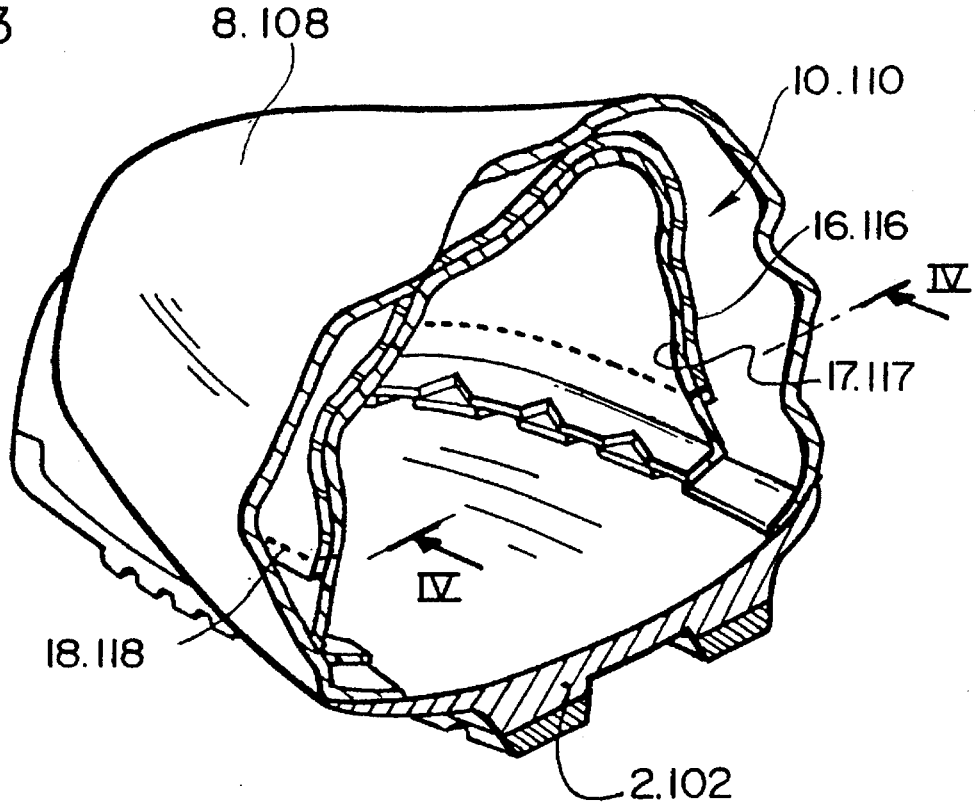
FIG. 3 is a detailed perspective view showing the assembly of the inner lining on the sole.
Figure 4:
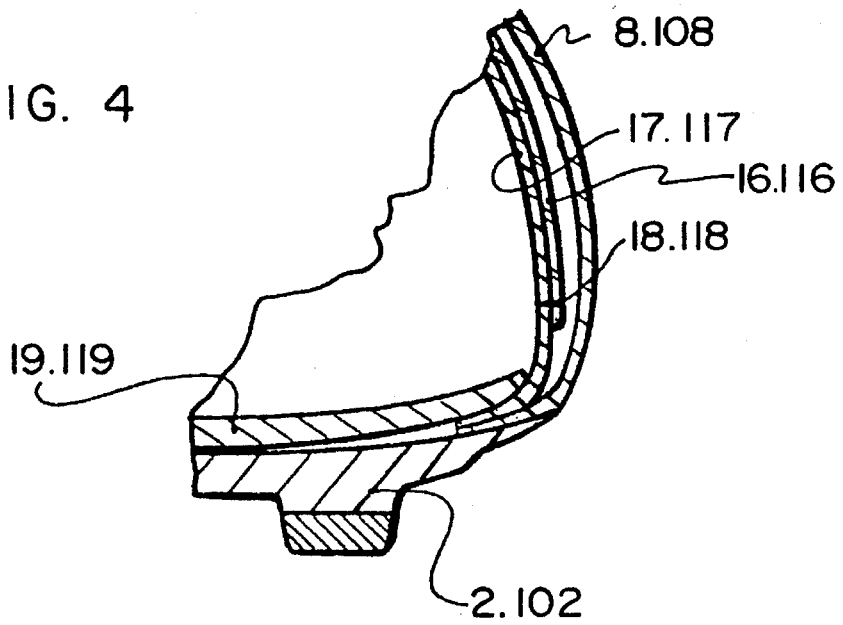
FIG. 4 is a partial sectional view along line IV—IV of FIG. 3.

In order to ensure optimum comfort for the user, the elastic portion or portions of each lining 10, 110 can be obtained in the form of a double layer of such elastic fabrics 16, 17 and 116, 117 as is represented in FIGS. 3 and 4.

In such a case, both layers 16, 17 and 116, 117 are assembled to one another by their peripheral edge, by a stitching 18, 118 or by adhesion, before assembly of the boot.

In order to reduce the thicknesses in the area of the assembly zone of the outer sole, only the inner layer 17, 117 will participate in the assembly with outer sole 2, 102, as is represented in FIG. 4 (Note: 19, 119 represents the insole assembly necessary in this type of assembly).

As is shown clearly in FIG. 4, a total continuity of the lining is thus obtained inside the boot in contact with the foot.

For the same reasons of ease of assembly, only the outer layer 16, 116 will be used to obtain stitching 15, 115 on the stiffener, especially when such stitching 15, 115 is also used for the assembly of tightening quarters 6, 106.

Such an embodiment also enables one to avoid placing such stitching 15, 115 in direct contact with the foot and thus enables heightened comfort and an optimal "second skin" sensation.

Naturally, the invention is not limited to the embodiments described hereinabove as non-limiting examples, but also applies to all boots adapted for the practice of gliding sports, such a ice-skating, roller skating and aligned roller skating, etc.

The present invention can also be applied to all sports shoes wherein a good transmission of information and a good perception of the spatial position of the foot with respect to the ankle are desired, as in walking or foot races.

The instant application is based upon French patent application 93.13299 of Nov. 4, 1993, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A sports boot comprising:

an outer sole having a peripheral zone;

a rear stiffener positioned for extending at least rearward of and on opposite sides of a heel of the foot of the wearer of the boot;

a vamp extending at least above a forepart of the foot;

an elastic lining extending above the forepart of the foot inside said vamp, said lining having a lower peripheral edge defining an opening;

said vamp and said rear stiffener being assembled to said outer sole along said peripheral zone of said outer sole;

said lower peripheral edge of said lining being assembled to said peripheral zone of said outer sole; and said lining being fixed to said rear stiffener.

2. A sports boot according to claim 1, further comprising:

an inner tightening system located between said vamp and said lining, said inner tightening system comprising two tightening quarters, each of said quarters having a first end connected on a respective opposite side of said peripheral zone of said outer sole and a second end, said respective second ends of said quarters having complementary tightening means, wherein at least one of said two quarters comprises a rear edge, and wherein said rear edge, said rear stiffener and said peripheral zone of said outer sole are all assembled together by a common stitching.

3. A sports boot according to claim 2, wherein:

said lining has a shape substantially of a sock, without a base, for covering the entire foot and ankle of the wearer.

4. A sports boot according to claim 3, wherein:

said lining includes portions defining a substantially vertical opening in an area corresponding to the ankle of the wearer.

5. A sports boot according to claim 4, wherein:

said substantially vertical opening extends from said outer sole to an upper edge of said lining.

6. A sports boot according to claim 1, wherein:

said lining comprises, at least in the area above the forepart of the foot, an inner layer of elastic fabric and an outer layer of elastic fabric, said inner and outer layers being joined by a peripheral stitching, said joined layers being thusly assembled to the boot, only said outer layer of said inner and outer layers of said lining being fixed to said rear stiffener.

7. A sports boot according to claim 6, wherein:

only said inner layer of said inner and outer layers of said lining is assembled to said peripheral zone of said outer sole.

8. A sports boot according to claim 1, wherein:

said elastic lining is sized so as to exert a slight pressure on the foot.

9. A sports boot according to claim 1, wherein:

said elastic lining is sized so as to exert a slight pressure on the foot, substantially above an area of a malleoli of the foot.

10. A sports boot comprising:

an outer sole having a peripheral zone;

a rear stiffener positioned for extending at least rearward of and on opposite sides of a heel of the foot of the wearer of the boot;

a vamp extending at least above a forepart of the foot;

an elastic lining extending above the forepart of the foot inside said vamp, said lining having a lower peripheral edge defining an opening;

said vamp and said rear stiffener being assembled to said outer sole along said peripheral zone of said outer sole;

said lower peripheral edge of said lining being assembled to said peripheral zone of said outer sole; and said boot having a flexion fold line, said lining being fixed to said rear stiffener substantially along said flexion fold line.

11. A sports boot according to claim 10, wherein:

said rear stiffener has opposite front edges extending upwardly from said outer sole, said front edges extending substantially along said flexion fold line.

12. A sports boot according to claim 10, further comprising:

an inner tightening system located between said vamp and said lining, said inner tightening system comprising two tightening quarters, each of said quarters having a first end connected on a respective opposite side of said peripheral zone of said outer sole and a second end, said respective second ends of said quarters having complementary tightening means, wherein at least one of said two quarters comprises a rear edge, and wherein said rear edge, said rear stiffener and said peripheral zone of said outer sole are all assembled together by a common stitching.

13. A sports boot according to claim 12, wherein:

said lining has a shape substantially of a sock, without a base, for covering the entire foot and ankle of the wearer.

14. A sports boot according to claim 13, wherein:

said lining includes portions defining a substantially vertical opening in an area corresponding to the ankle of the wearer.

15. A sports boot according to claim 14, wherein:

said substantially vertical opening extends from said outer sole to an upper edge of said lining.

16. A sports boot according to claim 10, wherein:

said lining comprises, at least in the area above the forepart of the foot, an inner layer of elastic fabric and an outer layer of elastic fabric, said inner and outer layers being joined by a peripheral stitching, said joined layers being thusly assembled to the boot, only said outer layer of said inner and outer layers of said lining being fixed to said rear stiffener.

17. A sports boot according to claim 16, wherein:

only said inner layer of said inner and outer layers of said lining is assembled to said peripheral zone of said outer sole.

18. A sports boot according to claim 10, wherein:

said elastic lining is sized so as to exert a slight pressure on the foot.

19. A sports boot according to claim 10, wherein:

said elastic lining is sized so as to exert a slight pressure on the foot, substantially above an area of a malleoli of the foot.

* * * * *